US006519778B2

(12) United States Patent
Arias et al.

(10) Patent No.: US 6,519,778 B2
(45) Date of Patent: Feb. 18, 2003

(54) SEPARABLE CHAIN SCARF FASHION ACCESSORY AND METHOD OF MANUFACTURE

(76) Inventors: Gina R. Arias, 1395 Harbor Dr., Sarasota, FL (US) 34239; Joy Robinson, 1395 Harbor Dr., Sarasota, FL (US) 34239

( * ) Notice: Subject to any disclaimer, the term of this patent is extended or adjusted under 35 U.S.C. 154(b) by 7 days.

(21) Appl. No.: 09/878,885

(22) Filed: Jun. 11, 2001

(65) Prior Publication Data

US 2002/0023289 A1 Feb. 28, 2002

Related U.S. Application Data

(63) Continuation-in-part of application No. 09/650,321, filed on Aug. 29, 2000, now Pat. No. 6,256,793.

(51) Int. Cl.[7] ..... A42B 5/00
(52) U.S. Cl. ..... 2/207; 2/321; 63/3
(58) Field of Search ..... 2/279, 313, 207, 2/321, 206, 146, 153; 63/3, 3.1, 3.2, 4, 38, 12.1–11

(56) References Cited

U.S. PATENT DOCUMENTS

| | | | | |
|---|---|---|---|---|
| 4,173,793 A | | 11/1979 | Kazuo | |
| D290,904 S | | 7/1987 | Crouch | |
| 5,720,049 A | * | 2/1998 | Clutton | 2/207 |
| 6,070,434 A | * | 6/2000 | Traver | 63/1.11 |
| 6,256,793 B1 | * | 7/2001 | Arias et al. | 2/207 |
| 6,282,722 B1 | * | 9/2001 | Pogachar | 2/206 |

* cited by examiner

*Primary Examiner*—Peter Nerbun
*Assistant Examiner*—Katherine Moran
(74) *Attorney, Agent, or Firm*—Dorothy S. Morse

(57) ABSTRACT

A decorative clothing accessory and a method for its manufacture, that comprises both scarf-like and jewelry components, and which can be worn comfortably even by those who are otherwise unable to tolerate clothing worn close against the neck. The present invention comprises an elongated flexible scarf-like member that is worn against the front and sides of a person's neck and a detachable jewelry member with adjustable fastening means that draws the scarf-like member around to the back of the wearer's neck and secures it into its usable position. If needed, the scarf-like member may include a soft fabric lining. Decorative embellishments for the scarf-like member may be included to add versatility. Although not limited thereto, the shape of the scarf-like member may be substantially rectangular, V-shaped, cowl-like, or have a subtle lower dip that follows the curvature of a human neck.

20 Claims, 4 Drawing Sheets

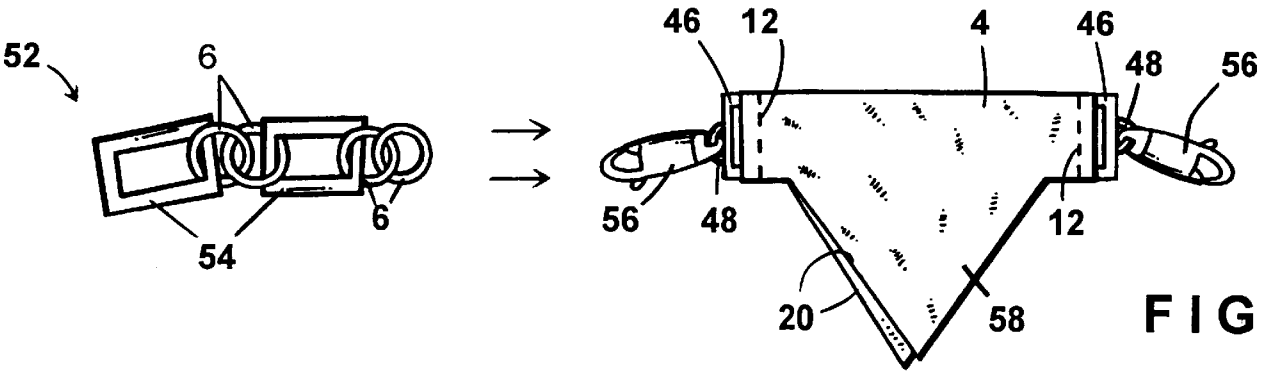
FIG. 4
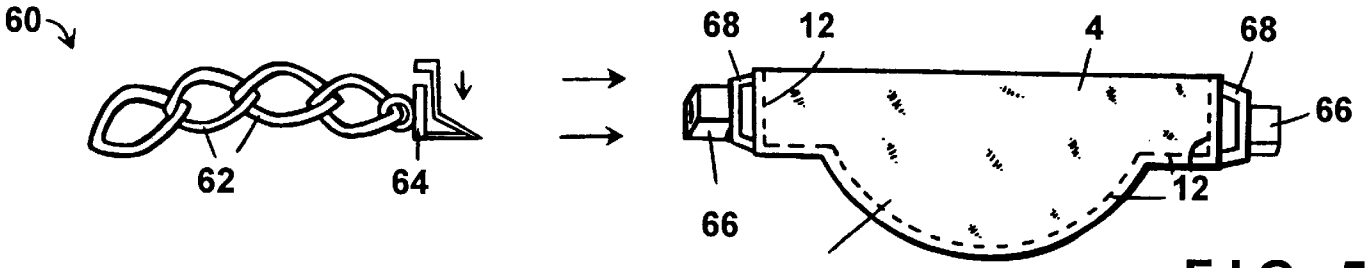
FIG. 5
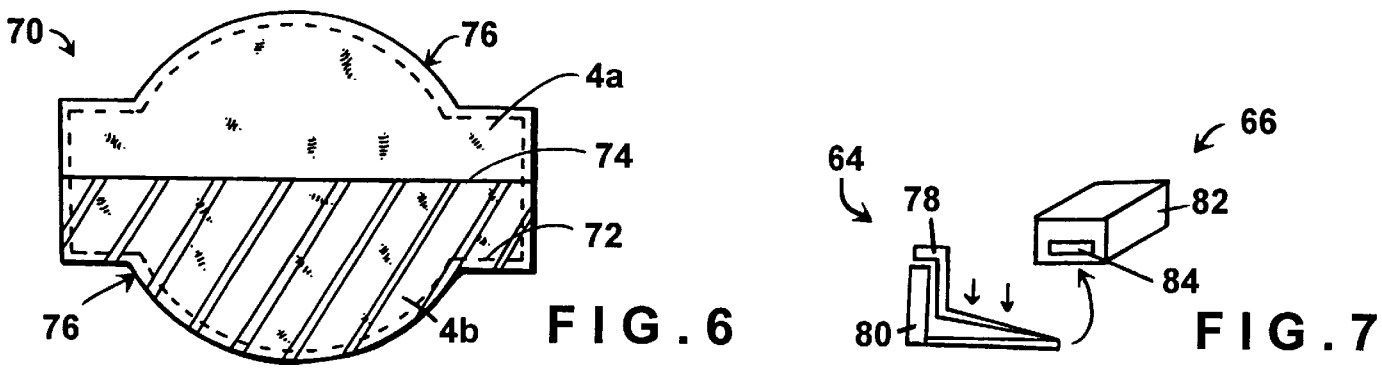
FIG. 6
FIG. 7

SEPARABLE CHAIN SCARF FASHION ACCESSORY AND METHOD OF MANUFACTURE

This patent application is a continuation-in-part of U.S. patent application Ser. No. 09/650,321, now U.S. Pat. No. 6,256,793, entitled Chain Scarf Fashion Accessory and Method of Manufacture and filed by the same inventors on Aug. 29, 2000, and the inventors request that they be permitted to derive any benefit to which they are entitled from the above-referenced earlier filed non-provisional patent application.

BACKGROUND—FIELD OF INVENTION

This invention relates to neck encircling fashion accessories, specifically to a decorative clothing accessory and a method for its manufacture, that comprises both scarf-like and jewelry components, and which can be worn comfortably around the lower and middle parts of the neck even by those who are otherwise unable to tolerate clothing that fits closely against the neck, such as turtleneck shirts and sweaters, bandanas, dickeys, and scarves. The present invention comprises an elongated flexible scarf-like member made from fabric or other material that is worn against the front and sides of a person's neck and a flexible jewelry component detachably connected to the opposite ends of the scarf-like member, so that different scarf-like members and jewelry components can be worn interchangeably. The jewelry component also comprises an adjustable fastening means that draws the opposing ends of the scarf-like member around toward the back of the wearer's neck and secures the scarf-like member comfortably into its usable position. Although not limited thereto, the configuration of the scarf-like member would preferably be substantially rectangular, V-shaped, cowl-like, have a lower dip that subtly follows the curvature of a human neck, or be in the form of a rectangle that is shortened in length so as to be puckered or gathered into folds or wrinkles that create a blouson effect. For maximum user comfort during use, the opposing ends of the scarf-like member should preferably remain at a spaced-apart distance from one another of approximately two to three inches. The neck-engaging surface of the scarf-like member which is targeted for contact with the front of a neck should be soft, and include a soft fabric lining, such as silk, when necessary for wearer comfort. Since the scarf-like member and jewelry components are detachable from one another, a person wanting to reduce the expense associated with repeated purchase of a jewelry component made from finer and expensive materials, could thereby purchase only one of the jewelry components and use it with a selection of scarf-like components for wardrobe versatility. In a majority of the preferred embodiments, the jewelry component would comprise a two-part chain having segments of unequal length, with each segment being configured to lay flat against a neck. However, even though a single two-part chain connection is preferred, multiple chain connections are also contemplated to support a single scarf-like member, to provide a design choice, to support scarf-like members having a greater height dimension, and to support scarf-like members made from heavier and/or bulkier materials, such as fur or leather. As a further design alternative, the jewelry component could comprise pearls, and gold or silver chain to which gemstones, rhinestones, or semi-precious stones are attached. All fasteners used with the present invention should be configured to lie flat against a neck, for easy and prompt connection, and have no sharp edges that can snag clothing or cause injury. It is also contemplated for the scarf-like member to comprise a wide variety of decorative embellishments, such as beads, pearls, rhinestones, embroidery, appliqués, reflective decorations, small mirrors, small buttons, fringe, lace, tassels, medallions, crests, shields, small chains, teardrop-shaped objects, and decorative trim. Applications may include the accessorizing of formal and career fashions, as well as use with clothing appropriate for more casual occasions.

BACKGROUND—DESCRIPTION OF PRIOR ART

Accessories can add color accents, color contrast, texture, and other decorative interest to clothing to create a coordinated and complete fashion statement. Neck adornment accessories are also effective for adding attractive and complementary color tones to a person's face, and can be used in advantageous ways to enhance facial features, hide neck imperfections, and complement unusual and dramatic hairstyles. Accessories providing neck adornment have traditionally been limited to jewelry, ribbons, bandanas, dickeys, and scarves. During their use, some of the prior art neck adornment devices, such as scarves and dickeys, rest against or drape about the lower part of a neck. Although they typically encircle a neck, they may or may not be closely held against the neck. Scarves are usually secured in place by opposing ends or comers being tied into a knot, at least one part thereof being fastened in place with a brooch or decorative pin, or opposing ends or comers being threaded through a piece of jewelry specifically configured for holding the opposed ends of a scarf. However, the disadvantage of large bandanas and scarves is that even when they are tied or pinned they can be quite bulky, and while they may be suitable for use with certain formal and/or career fashions, they often are inappropriate for use with more casual clothing. Dickeys also can be bulky and are often unsuited for use with more casual clothing.

Other prior art neck accessories are used to adorn the middle part of a neck and must be secured closely against a substantial portion of the neck circumference to prevent inadvertent downward slippage to the lower part of the neck during use. When close contact exists between a neck adornment device and the entire circumference of the neck, such as would occur when smaller scarves, ribbons, and bandanas are tied around a neck, it often creates an uncomfortable constricted feeling that can also be accompanied by a further unpleasant sensation of choking or gagging. When prior art neck adornment devices contemplated for use around the middle part of the neck are configured to encircle only a portion of a neck, they must be rigid in construction and able to tightly grip the front, sides, and/or back of the neck. Although rigid neck adornment devices, such as C-shaped wire-like necklaces, may be comfortable when the person wearing it remains substantially still, when the wearer makes any type of neck twisting movement, the rigid necklace will not move in unison with the wearer and can provide unpleasant neck restricting sensations. While adornment around the middle portion of a neck is desirable for its fashion enhancing and face flattering effects, there is no known neck adornment device for wear around the middle portion of a neck that is non-bulky and sufficiently comfortable for extended use.

Further, while neck-encircling jewelry can add texture and decorative interest to clothing, it is generally limited in its contribution of color. Also, while ribbons, bandanas, dickeys, and scarves can add wonderful color accent and contrast to complete a fashion statement, scarves and dickeys are generally bulky and therefore limited in use, and neck-encircling ribbons while not bulky must be held tightly against the middle part of a neck and are found by many to be too constricting for frequent or extended use. Therefore, it would be desirable, and it is not heretofore known to have a combination fashion accessory comprising both jewelry and scarf-like components which is easily adjustable so that one or two sizes can be comfortably worn around most adult necks, even by those who otherwise find turtleneck clothing and accessories secured against the neck too constricting for frequent or extended use, with the jewelry component providing texture and decorative interest needed to accessorize fashions and the scarf-like component providing color and additional texture interest, and further with the jewelry and scarf-like components being quickly and easily separable from one another so that differently paired jewelry and scarf-like components can be worn interchangeably.

The inventions thought to be most closely associated with the present invention are disclosed in U.S. Design Patent D290904 to Crouch (1987), U.S. Pat. No. 4,173,793 to Kazuo (1977), and U.S. Pat. No. 5,720,049 to Clutton (1998). However, there are important differences between these inventions and the present invention. The dickey shown in the Crouch invention appears from a front view to resemble the cowl-like embodiment of the present invention, but does not resemble any of the other embodiments of the present invention. Also, the Crouch invention appears to be longer than the present invention and to extend farther downward over the upper chest area adjacent to the neck. In addition, the Crouch invention appears to be bulkier than the present invention, and it completely encircles a neck with no jewelry component against the back of a neck to help prevent the neck constricting sensation produced by many devices positioned closely against a neck during use. Further, while the Kazuo invention comprises a wire, a hook, and a chain, components that are also used in the present invention, and while it is used with scarves, the Kazuo invention discloses a knot-retaining implement that helps to maintain knots formed in neck-encircling devices such as neckties and scarves from becoming loosened during use. The Kazuo invention does not function as a neck-encircling device. Also, while the Kazuo invention can be attached to a scarf near to its ends, it is detachably connected to a knot in the scarf and its chain is not connected to the ends of a scarf or scarf-like member, as in the present invention, to help the scarf or scarf-like member encircle a neck and become positioned directly against it without the neck constricting sensation that often is felt by a wearer. The Clutton invention comprises an elongated piece of fabric and drawing-in members used to gather the ends of the fabric. Further, the Clutton invention discloses one attachment loop connected to each drawing-in member, a different part of a two-part screw-barrel fastener connected to each loop, and the drawing-in members and screw-barrel fastener being jewelry-like. In contrast to the present invention, the Clutton invention does not teach a plurality of chain links which can be utilized to make it adjustable, nor the need for a plurality of chain links to limit the coverage of the elongated fabric member to only the front and sides of the neck to prevent a sensitive wearer from experiencing a constricted and/or choking feeling during use. One of the fundamental objectives for creation of the present invention was to fulfill a need for a decorative neck accessory that does not have fabric completely encircling a neck so that an undue amount of pressure is not placed against the front of the neck to cause a constricted feeling. Also, the Clutton invention does not teach the need for a construction similar to the adjustable, multiple chain link construction of the present invention with interchangeable scarf-like and jewelry components to promote versatility of use, which also overcomes the discomfort typically experienced by sensitive people with prior art devices that substantially comprise fabric. No invention is known that has all of the features of the present invention, nor one with all of its advantages.

SUMMARY OF INVENTION—OBJECTS AND ADVANTAGES

The primary object of this invention is to provide a quickly attached and released lightweight neck-encircling fashion device that comprises both scarf-like and jewelry components for diversity in accessorizing formal and career clothing, as well as casual clothing, and whose jewelry components can be readily detachable from its scarf-like component for interchangeable use. A further object of this invention is to provide a chain-scarf accessory that has soft fabric available for engagement with the front of a neck and is configured so that its scarf-like component covers only the front and sides of the wearer's neck, leaving the back of the neck adorned only by the jewelry component so that people who typically feel uncomfortable when wearing tight clothing around the neck will not experience an unpleasant neck constricting sensation when wearing the present invention. It is a further object of this invention to provide decorative embellishments for the chain-scarf accessory to enhance its versatility as a fashion accessory, including embellishments that hang below the scarf-like component. It is also an object of this invention to provide an adjustable chain-scarf accessory that allows one or two sizes to fit most adult necks. A further object of this invention is to provide a chain-scarf accessory that has a configuration easily manufactured in a smaller size for children. It is also an object of this invention to provide a chain-scarf accessory with fasteners that lay flat against a neck and have a blunt configuration that will not snag clothing or cause injury. It is a further object of this invention to provide a chain-scarf accessory that is efficiently constructed, has durable construction, and is made from materials that require little or no maintenance between uses.

As described herein, properly manufactured and used, the present invention would provide a versatile chain-scarf fashion accessory that could be worn with formal and career fashions, as well as casual clothing. It has a jewelry member used against the back of a neck and a flexible elongated scarf-like member for use against the front and sides of the neck, with at least the center portion of the neck-engaging surface of the scarf-like member being made from soft fabric, such as silk. Since the scarf-like member and jewelry components are detachable from one another, a person wanting to reduce the expense associated with repeated purchase of a jewelry component made from finer and more expensive materials, could thereby purchase only one of the jewelry components and use it with a selection of scarf-like components for wardrobe versatility. The scarf-like member can be made from a variety of materials to include simple, sheer, elegant and/or expensive fabrics, fur, and leather, as well as colorful fabrics with trend-setting patterns and textures, to provide a multitude of aesthetically pleasing, neck-enhancing, and face flattering fashion statements. If the material used for the scarf-like member is not soft or delicate, a lining could optionally provide the soft surface needed for contact with at least the front portion of a neck. Such lining could be detachable for laundering purposes. Also, where desired, the scarf-like member could be decoratively enhanced with permanently attached or detachable embellishments, such as pearls, beads, gemstones, rhinestones, sequins, tassels, appliqués, embroidery, reflective decorations, chains, decorative trim, and the like, including embellishments that hang below the scarf-like member. The scarf-like member can be wide or narrow in height dimension, and have a variety of configurations, to include but not be limited to, one that is substantially rectangular with top and bottom edges approximately parallel to one another, one that has a bottom edge with a convexly shaped lower dip configured for subtly following the curvature of a human neck, one having a V-shaped dip on its lower edge, one having a draped cowl-like dip, and one having a primarily rectangular configuration that is shortened in length so as to be puckered or gathered into folds or wrinkles that create a blouson effect. To prevent a constricted feeling around the neck while it is being worn, both ends of the scarf-like member are attached to separate parts of a flexible jewelry component that are used to draw the opposing ends of the scarf-like member toward the back of the wearer's neck. An adjustable fastener is then used to secure the scarf-like member comfortably into its non-slip usable position. Optimally, a spaced-apart distance would remain between the opposing ends of the scarf-like member during use. It is preferred that the jewelry member be adjustable so that one or two sizes of the present invention will fit most adult necks, and one smaller embodiment could be easily manufactured for most children. In the most preferred embodiment of the present invention the jewelry member would comprise two chain segments of unequal lengths, each having large links or rings comparable in size to the height dimension of the scarf-like member ends to which it will become attached, and a toggle attached to the shorter chain segment. The toggle would be configured for easy engagement and disengagement with any link in the longer section of chain to provide the adjustable connection desired. The toggle fastener would also be configured and attached to lie flat against a neck, and its blunt ends would prevent clothing snags and wearer injury. Other fasteners, such as but not limited to lobster claw fasteners, ring-shaped fasteners, magnetic fasteners, fasteners with a sliding type of clasp engagement, and fasteners having a spring-biased connection, are also considered to be within the scope of the present invention even though they might not be as readily fastened as a toggle fastener, as long as they do not possess sharp and pointed edges that could cause clothing damage or injury to the person wearing it. Exceptionally wide scarf-like members, and those made from bulkier materials, could utilize additional chain segments, such as two or three chain connections across the back of a neck instead of the single two-part chain connection more frequently used. Further, since it is contemplated for the raw edges of the fabric in the scarf-like member to be alternatively stitched to one another to make a hidden seam, be formed into a rolled hem, or otherwise manipulated and secured to prevent unraveling or fraying, and since the jewelry member is flexible and configured to lie flat against a neck during use, the chain-scarf accessory of the present invention would be worn comfortably for extended periods of time, and could be repeatedly used without visible signs of wear. The detachable fasteners between the scarf-like member and the jewelry component, as well as the connectors attached to the scarf-like member and to which the detachable fasteners are joined, such as but not limited to connectors that are D-shaped, rectangular, triangular, trapezoidal, decoratively D-shaped, and the like, are also configured to lie flat against a neck during use to enhance user comfort. It is also contemplated that the present invention would be made from fabric, jewelry, and decorative embellishments not adversely affected by dry cleaning products or periodic hand washing. It is also expected that materials selected for the chain scarf invention would require little maintenance or care between uses.

The description herein provides the preferred embodiments of the present invention but should not be construed as limiting the scope of the chain-scarf invention. For example, variations in the type, thickness, and configuration of the fabric used for the scarf-like member; the presence and shape of a lower dip on the scarf-like member; the number of chain attachment points at the back of the wearer's neck; the amount and placement of reinforcement stitching used on the scarf-like member; the type of adjustable fastening means used; the configuration of the detachable chain-to-scarf fasteners used; the number and configuration of the pleats used on the scarf-like member having a cowl-like dip to help to add fullness to certain fabrics to create a more pleasing cowl-like appearance, and the number, type, and combination of embellishments used, other than those shown and described herein, may be incorporated into the present invention. Thus the scope of the present invention should be determined by the appended claims and their legal equivalents, rather than the examples given.

BRIEF DESCRIPTION OF THE DRAWINGS

FIG. 4 is plan view of a fourth preferred embodiment of the present invention having a scarf-like member with a V-shaped dip and a rolled hem, a rectangular-shaped connector with an outwardly depending loop attached to each end of the scarf-like member, one chain segment having rectangular and round links that are near in size to the height dimension of the ends of the scarf-like member, a lobster claw fastener permanently attached to each of the outwardly depending loops, and the chain segment being in a position poised for attachment to one of the lobster claw fasteners.

FIG. 5 is a plan view of a fifth preferred embodiment of the present invention having a scarf-like member with a subtle dip configured for following the curvature of a human neck, a trapezoid-shaped connector attached to each end of the scarf-like member, one chain segment having diamond-shaped links near in size to the height dimension of the ends of the scarf-like member, the chain segment being in a position poised for attachment to one of the trapezoid-shaped connectors through use of a spring-biased fastener.

FIG. 6 is a plan view of a scarf-like member for a sixth preferred embodiment of the present invention that can be reversible, the scarf-like member having two pieces of fabric or material with distinguishable patterns and/or colors that are longitudinally joined together.

FIG. 7 is a perspective view of the spring-biased fastener shown in FIG. 6 and used to secure the jewelry component to the scarf-like member in the fifth preferred embodiment of the present invention.

DETAILED DESCRIPTION OF PREFERRED EMBODIMENTS

Figures 1, 2, 3:
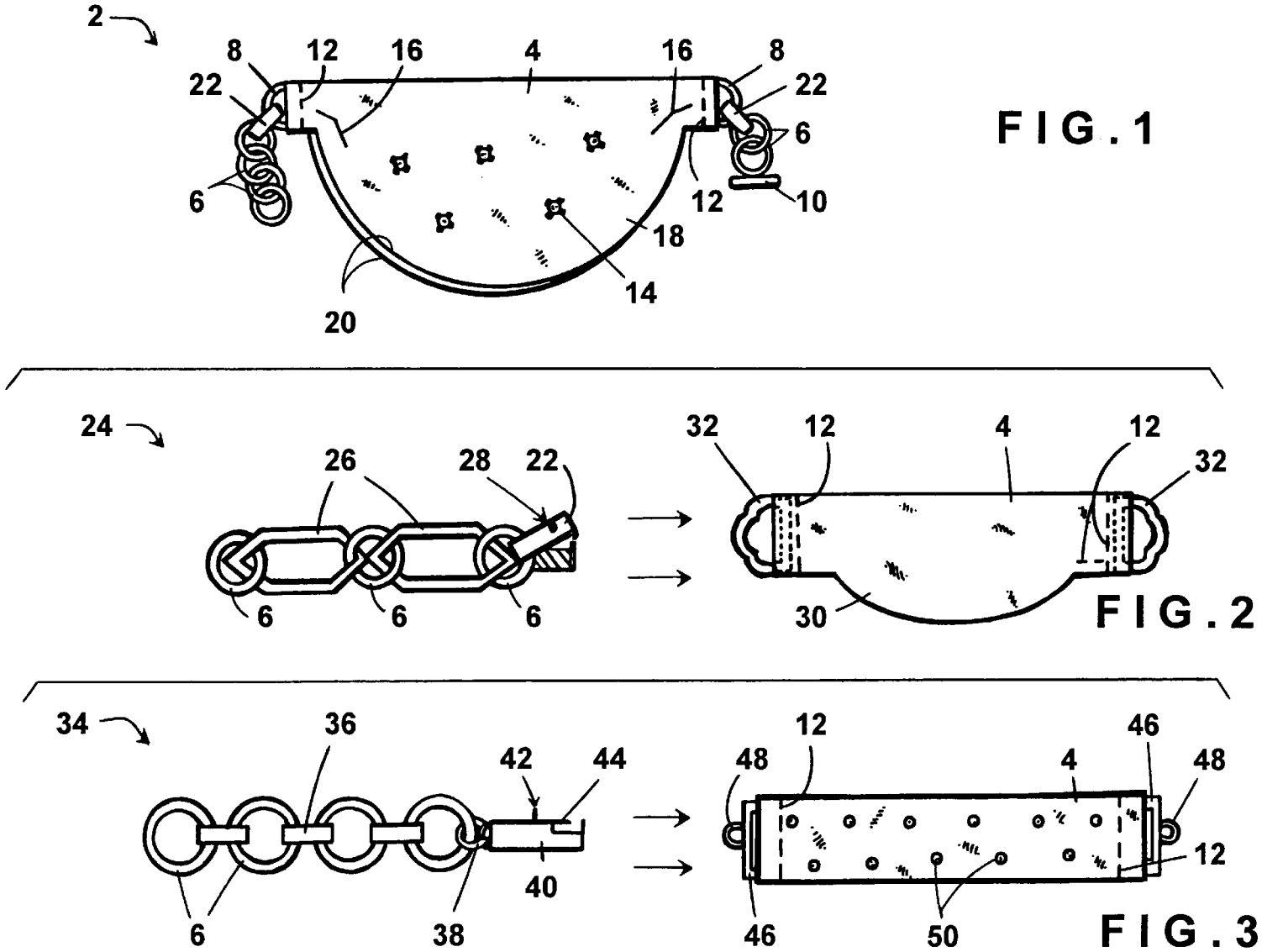
FIG. 1 is a plan view of a first preferred embodiment of the present invention having a scarf-like member with a cowl-like dip, a rolled hem, and decorative rhinestone embellishments, with a D-ring connector attached to each end of the scarf-like member, and with a chain segment having round links connected to each of the D-ring connectors through use of a detachable fastener that is V-shaped is its opened position and assumes the shape of an oval loop in its snap-together closed position, the shorter one of the chain segments also having a toggle fastener attached to its distal end.
FIG. 2 is a plan view of a second preferred embodiment of the present invention having a scarf-like member with a subtle dip configured for following the curvature of a human neck, a decorative substantially D-shaped connector attached to each end of the scarf-like member, with one chain segment having alternating elongated hexagonal links and round links in a position poised for connection to one of the decorative D-shaped connectors through use of the V-shaped detachable fastener shown in FIG. 1.
FIG. 3 is a plan view of a third preferred embodiment of the present invention having a rectangular scarf-like member with pearl or bead-like embellishments attached thereto and no dip, a rectangular-shaped connector with an outwardly depending loop connected to each end of the scarf-like member, with one chain segment having several round links separated by rectangular-shaped bands in a position poised for attachment to one of the outwardly depending loops through use of a quick-release fastener having a retractable sliding type of clasp action.

FIG. 1 shows a first preferred embodiment 2 of the present chain scarf invention having an elongated scarf-like member 4 and a two-part jewelry member consisting of a longer segment of interconnected chain links or rings 6 attached to one end of scarf-like member 4 and a shorter second segment of interconnected chain links or rings 6 having a toggle fastener 10 connected to its distal end being attached to the other end of scarf-like member 4. The additional chain links or rings 6 on the end of scarf-like member 4 remote from toggle fastener 10, while allowing for adjustable connection of first preferred embodiment 2 around a human neck, shown by the number 116 in FIGS. 11 and 13, would also allow toggle fastener 10, or any other fastener used, to become more centrally located on the back of most necks during use, for a balanced and more aesthetically pleasing appearance, similar to that shown in FIG. 11. Any type of jewelry fastener that is able to allow first preferred embodiment 2 to be adjustably connected around a human neck is considered to be within the scope of the present invention and first preferred embodiment 2 is not limited to the use of toggle fastener 10. Although not critical to the present invention, the scarf-like member 4 in first preferred embodiment 2 has a cowl-like dip 18 and rhinestone embellishments 14. First preferred embodiment 2 could be made from one-piece folded construction of scarf-like member 4, or in the alternative multiple-piece construction of several scarf-like members 4, whereby several independently hanging cowl-like dips 18 would be layered on top of one another. FIG. 1 also shows scarf-like member 4 in first preferred embodiment 2 having a rolled hem 20 and lateral pleats 16. In most preferred embodiments of the present invention having cowl-like dips 18, it is contemplated that the cowl-like dips 18 superimposed upon one another, in the manner shown in FIG. 1, will not be stitched together. The independent rolled hems 20 allow the two cowl-like dips 18 to hang in a downward direction loosely and separately, one upon the other, to give first preferred embodiment 2 a full and draped cowl-like appearance. Similarly, pleats 16 help to add fullness to certain fabrics to create a more pleasing cowl-like appearance. Two or more pleats 16 could be used, and it is not contemplated for the number and configuration of pleats 16 to be limited to that shown in FIG. 1. FIG. 1 further shows a two-part jewelry member consisting of four round chain links or rings 6 attached to one D-ring 8 through use of a first snap-together detachable fastener 22, with two round chain links or rings 6 and a toggle 10 connected by a second snap-together detachable fastener 22. Although not limited thereto, round links or rings 6 are shown in FIG. 1 to be near in size to the height dimension of the ends of the scarf-like member 4. Further, although the height dimensions of scarf-like member 4 and chain links or rings 6 appear to be nearly the same and are in correct proportion to one another, the length of scarf-like member 4 relative to the length dimension of the interconnected chain links or rings 6 is not in exact proportion and appears shorter for illustrative purposes. The central portion of toggle fastener 10 is attached to the distal chain link or ring 6 on the shorter chain segment so that all of the chain links or rings 6 connected thereto are positioned between toggle fastener 10 and scarf-like member 4. As can be seen in FIG. 1, toggle fastener 10 has an elongated configuration and opposed blunt ends that are incapable of snagging fabric, or of causing injury to a person manipulating it or to the neck of the person wearing it. Toggle fastener 10 is also configured so that it can be fully inserted through one or more of the chain links or rings 6 attached to the end of scarf-like member 4 remote from toggle fastener 10. Although any type of easy-to-use jewelry fastener allowing first preferred embodiment 2 to be adjustably connected around a human neck (not shown) is considered within the scope of the present invention, the preferred fastening means should also lay flat against the circumference of the neck and should be configured so as not to snag clothing or lay uncomfortably against the skin of the person wearing it. As also seen in FIG. 1, there are a greater number of chain links or rings 6 on the end of scarf-like member 4 remote from toggle fastener 10. This allows the adjustable connection that places toggle fastener 10 more centrally on the back of most necks during use, such as neck 116 shown in FIG. 11, for a balanced and more aesthetically pleasing appearance. FIG. 1 further shows first preferred embodiment 2 having a D-ring connector 8 attached to each end of scarf-like member 4 as a means of attaching chain links or rings 6 to scarf-like member 4 through use of snap-together detachable fastener 22. The use of D-ring connector 8 is not critical for this function and it is contemplated for other chain-to-scarf connectors to be used, such as but not limited to decorative D-shaped connector 32 in FIG. 2, rectangular-shaped connector 46 shown in FIGS. 3 and 4, as well as trapezoidal connector 68 in FIG. 5, triangular connector 90 in FIG. 8, and octagonal connector 122 in FIG. 10. Further, the amount of each D-ring connector 8, or other chain-to-scarf connector used, that remains visible after assembly of first preferred embodiment 2 is a matter of design choice. As shown in FIG. 1, detachable fastener 22 has the closed configuration of an elongated loop, while FIG. 2 reveals the partially opened V-shaped configuration of detachable fastener 22. A part of the pivoting end of V-shaped detachable fastener 22 could either be permanently attached to the proximal chain link or ring 6 on the longer chain segment, permanently attached to D-ring connector 8, or as shown in FIG. 1 completely detachable from D-ring connector 8 and the proximal chain link or ring 6. In addition, FIG. 1 shows two approximately parallel spaced-apart lines of reinforcement stitching 12 on scarf-like member 4, with one line of reinforcement stitching 12 being adjacent to each D-ring connector 8 and extending the full height dimension of scarf-like member 4. Also, each line of reinforcement stitching 12 is positioned between the cowl-like dip 18 on the lower edge of scarf-like member 4 and a different one of the opposed ends of scarf-like member 4, with the adjacent D-ring connector 8 positioned laterally to reinforcement stitching 12. The addition of reinforcement stitching 12 helps to strengthen the ends of scarf-like member 4 and to maintain each D-ring connector 8 in its optimal position during use. FIG. 1 also shows cowl-like dip 18 centered on the lower edge of scarf-like member 4 and the upper edge of scarf-like member 4 having a substantially straight and unadorned configuration. Although a straight and unadorned configuration is preferred, it is also considered within the scope of the present invention for scarf-like member 4 to have other upper edge configurations, including those that are arcuate, angled, or a combination thereof.

Although not shown in FIG. 1, and not limited thereto, it is contemplated for first preferred embodiment 2 of the present invention to be made from thin, soft, and lightweight fabrics, such as but not limited to silk, polyester, linen, rayon, and chiffon, although some medium weight fabrics, such as but not limited to cashmere, suede, and velvet, would also be suitable. When fabrics and materials having a greater thickness dimension are used, and where necessary for the comfort of the person wearing it, a soft lining material could at least be attached to the central part of the neck-engaging back surface of scarf-like member 4 that is intended for contact with the front of a wearer's neck (not shown). The contemplated lining, made from soft materials such as but not limited to silk, could be permanently attached to scarf-like member 4 or detachably connected to it with easily manipulated fasteners (not shown), such as snaps or hook-and-loop fasteners. Although not limited thereto, in first preferred embodiment 2, the length dimension of scarf-like member 4 would be approximately eleven inches. The corresponding maximum height dimension of scarf-like member 4 would be approximately six inches. Although other sizes of chain links or rings 6 are considered within the scope of the present invention, in the corresponding jewelry component it is preferred that chain links or rings 6 each have a width dimension of approximately three-fourths of an inch and for the longer connected segment of chain links or rings 6 to be approximately three inches in length. In first preferred embodiment 2, chain links or rings 6, D-ring connector 8, and toggle fastener 10 would be made from gold, silver, a combination of gold and silver, gold-filled materials, gold plated materials, silver plated materials and other non-tarnishing materials resembling gold and silver, to provide the versatility of being able to offer less expensive embodiments for career use, as well as more expensive embodiments for more formal occasions, such as weddings. It is also contemplated for chain links or rings 6 to comprise further embellishments, such as but not limited to gemstones, rhinestones, and pearls. The cost of chain links or rings 6 for the more expensive embodiments would generally be greater than the cost of the fabric or material for scarf-like member 4. Thus, the detachability of chain links or rings 6 from scarf-like member 4 would make the expensive embodiments affordable to more people, as a person interested in wearing the more expensive embodiments of the present invention could purchase one expensive set of chain links or rings 6, and use it alternatively with many different scarf-like members 4. Decorative embellishments are contemplated for first preferred embodiment 2 as long as they are sufficiently small and lightweight, such as rhinestone embellishments 14, so as not to weight down the fabric of scarf-like member 4 and destroy its cowl-like appearance, and such embellishments could include but are not limited to small appliques, beads, pearls, sequins, small gemstones, small rhinestones, small buttons, small reflective devices, embroidery, lace, decorative trim, and the like.

Figure 13:
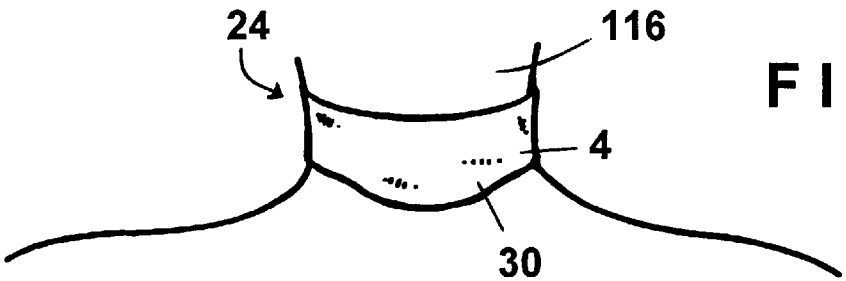
FIG. 13 is a front view of the second preferred embodiment of the present invention having a subtle dip and being secured around the front of a human neck.

FIG. 2 shows a second preferred embodiment 24 of the present invention having a scarf-like member 4 with a subtle dip 30 configured for following the curvature of a human neck, such as neck 1 16 shown in FIG. 13, a decorative D-shaped connector 32 attached to each end of scarf-like member 4, with one jewelry component having alternating elongated hexagonal links 26 and round chain links or rings 6 poised for connection to one of the decorative D-shaped connectors 32 through use of the same type of snap-together V-shaped detachable fastener 22 shown in FIG. 1. Although any type of easy-to-use fastener allowing the second preferred embodiment 24 to be promptly and adjustably connected around a human neck is considered within the scope of the present invention, the preferred fastening means should also lay flat against the circumference of the neck and should be configured so as not to snag clothing or lay uncomfortably against the skin of the person wearing it. Such a fastener would be connected to the distal end of a shorter second jewelry component is not shown in FIG. 2. However, a chain segment shorter than the one having two elongated hexagonal links 26 and three round chain links or rings 6 would need to be attached to the other end of scarf-like member 4 for use of second preferred embodiment 30. Although not limited thereto, the shorter chain segment could possibly have one elongated hexagonal link 26 and one round chain link or ring 6, one elongated hexagonal link 26, one shortened hexagonal link 26 and one round chain link or ring 6, two round chain links or rings 6, two shortened hexagonal links 26, or chain links or closed rings having other aesthetically pleasing configurations and which are also able to lie flat against a human neck (not shown). Even though the height dimensions of scarf-like member 4, elongated hexagonal links 26, and round chain link or rings 6 appear to be nearly the same, and are in correct proportion to one another, scarf-like member 4 has been shortened to approximately half of its normal length relative to the length dimension of elongated hexagonal links 26 and round chain link or rings 6 for illustrative purposes. In addition, FIG. 2 shows two approximately parallel spaced-apart lines of reinforcement stitching 12 on scarf-like member 4, one adjacent to each decorative D-shaped connector 32, which extend the full height dimension of scarf-like member 4. Also, each line of reinforcement stitching 12 is positioned between a subtle convexly-shaped dip 30 on the lower edge of scarf-like member 4 and a different one of the opposed ends of scarf-like positioned laterally to reinforcement stitching 12. The addition of reinforcement stitching 12 helps to strengthen the ends of scarf-like member 4 and to maintain each decorative D-shaped connector 32 in its optimal position during use. FIG. 2 also shows a short quantity of reinforcement stitching 12 along the lower edge of scarf-like member 4 between one of the longer parallel lines of reinforcement stitching 12 and subtle dip 30. The short quantity of reinforcement stitching 12 on the lower edge is used to seal an opening (not shown), when one is employed during manufacture for turning scarf-like member 4 right-side-out after its perimeter seams are stitched. FIG. 2 also shows subtle dip 30 centered on the lower edge of scarf-like member 4, which is configured to follow the curvature on the front of a human neck, such as neck 116 in FIG. 13, and allow a scarf-like member 4 of medium height dimension to more easily lay flat against the neck. Although not critical to second preferred embodiment 24, FIG. 2 shows the upper edge of scarf-like member 4 having a substantially straight and unadorned configuration. Although a straight configuration is preferred, it is also considered within the scope of the present invention for scarf-like member 4 to have other upper edge configurations, including those that are arcuate, angled, or a combination thereof.

Although not shown in FIG. 2, and not limited to the following, it is contemplated for second preferred embodiment 24 having subtle dip 30 to be made from thin, soft, lightweight fabrics such as silk, polyester, linen, rayon, and chiffon. However, embodiments having a subtle dip 30 could also be made from other fabrics, including those having a more substantial thickness dimension, such as but not limited to cashmere, faux fur, and mink. When thicker fabrics and materials are used and where necessary for the comfort of the person wearing it, a soft lining (not shown) could be permanently or detachably connected to the neck-engaging back surface of scarf-like member 4. Such lining could extend across the entire back surface of scarf-like member 4, or in the alternative be only attached to the portion of scarf-like member 4 anticipated for direct contact with the front of a neck, such as neck 116 in FIG. 13. Also, although not shown, fasteners such as snaps or hook-and-loop fasteners could be used to allow detachable connection of a lining to the remainder of scarf-like member 4 for laundering purposes. Similar to the use of a lining, an additional layer of fabric (not shown) could be secured between the front and back surfaces of scarf-like member 4 to provide color contrast or support when scarf-like member 4 is made from sheer fabrics. This additional layer could be attached to scarf-like member 4 prior to the stitched attachment of decorative D-shaped connectors 32 or other connectors to scarf-like member 4, or simultaneously with such stitching. Further, although not limited to such dimension, for most purposes second preferred embodiment 24 having subtle dip 30 would have a scarf-like member 4 with a length dimension of approximately ten-and-one-half inches. The corresponding height dimensions of scarf-like member 4 at each of its ends would be approximately three-fourths of an inch, and scarf-like member 4 would have a central height dimension of approximately two-and-one-half inches. Although chain links or rings 6 having smaller or larger height dimensions are considered within the scope of the present invention, as well as the use of four or six chain segments with a corresponding increase in the number of decorative D-shaped connectors 32 being used to pull the ends of scarf-like member 4 toward the back of a human neck or the number of attachment points on each decorative D-shaped connector 32 shown in FIG. 2 for attachment of additional chain segments smaller than those shown in FIG. 2, for most purposes in the jewelry component of second preferred embodiment 24, it is preferred that only two chain segments be used and for each chain segment to have a height dimension of approximately three-fourths of an inch, the same height dimension as the ends of scarf-like member 4. Also in second preferred embodiment 24, for most purposes the longer chain segment attached to scarf-like member 4 would have a maximum length dimension of approximately three inches. Further, in second preferred embodiment 24, to provide the versatility of being able to offer less expensive embodiments for casual use, as well as more expensive embodiments for career use, weddings, and other formal occasion use, decorative D-shaped connectors 32 and toggle fastener 10 could be made from gold, silver, a combination of gold and silver, gold-filled materials, gold plated materials, silver plated materials, and other non-tarnishing materials resembling gold and silver, with elongated hexagonal links 26 and chain links or rings 6 being made from the same materials as well as pearls, gemstones, rhinestones, and semi-precious stones. Decorative embellishments for the second preferred embodiment 24 of the chain scarf invention could include fringe, appliqués, patches, pearls, beads, sequins, gemstones, rhinestones, small buttons, embroidery, lace, reflective decorations, tassels, small mirrors, medallions, crests, shields, small chains, teardrop-shaped objects, decorative trim, and the like. In addition, although not limited thereto, in second preferred embodiment 24 and for maximum comfort of the person wearing it, the optimum spaced-apart distance between the ends of scarf-like member 4 while it encircles a neck would be approximately two to three inches.

FIG. 3 shows a third embodiment 34 of the present invention having scarf-like member 4 with pearl or bead-like embellishments 50, a rectangular-shaped connector 46 with an outwardly depending loop 48 connected to each end of scarf-like member 4, with one jewelry component having several round chain links or rings 6 uniformly spaced apart and separated by solid rectangular-shaped bands 36, and the jewelry component being in a position poised for attachment to the outwardly depending loop 48 on one of the rectangular connectors 46 through use of a rectangular-shaped fastener 40 having a sliding clasp 44. As in FIG. 2, although the height dimensions of scarf-like member 4 and chain links or rings 6 in FIG. 3 appear to be nearly the same and are in correct proportion to one another, scarf-like member 4 has been shortened to approximately half of its usual length relative to the length dimension of the chain links or rings 6 for illustrative purposes. Similar to all of the preferred embodiments disclosed herein except for the first preferred embodiment in FIG. 1, two jewelry segments of unequal length are contemplated for use in FIG. 3, however, only the longer one is illustrated. FIG. 3 shows scarf-like member 4 having opposing top and bottom edges approximately parallel to one another in place of the subtle lower dip 30 shown in FIG. 2. Third preferred embodiment 34 also has a two-part jewelry member consisting of a longer chain segment of uniformly spaced-apart chain links or rings 6 separated by solid rectangular-shaped bands 36 and a shorter second jewelry segment (not shown) in combination with an adjustable fastener, such as but not limited to the toggle fastener 10 shown in FIG. 1. Any type of fastener allowing third embodiment 34 to be adjustably connected around a neck is considered within the scope of the present invention. Also, such fasteners should lie flat against the neck and be configured bluntly so as not to snag clothing or lay uncomfortably against the skin of the person wearing it. FIG. 3 further shows third preferred embodiment 34 having one rectangular-shaped connector 46 with an outwardly depending loop 48 attached to each end of scarf-like member 4 as a means of connecting chain links or rings 6 on the two jewelry segments to scarf-like member 4 through a detachable rectangular-shaped fastener 40, which is similar in function to a snap-bolt with a sliding clasp 44 and a protrusion 42 for use in temporary retraction of sliding clasp 44 and release of detachable fastener 40 from one of the depending loops 48. FIG. 3 shows rectangular-shaped fastener 40 permanently connected to the distal chain link or ring 6 on the longer jewelry segment. However, in the alternative, it is equally contemplated for each rectangular-shaped fastener 40 used in third preferred embodiment 34 to be permanently connected to the outwardly depending loop 48 on one of the rectangular-shaped connectors 46. In addition FIG. 3 shows reinforcement stitching 12 adjacent to each rectangular-shaped fastener 46. The use of rectangular-shaped fastener 46 with an outwardly depending loop 48 for third preferred embodiment 34, while preferred, is not critical. No other stitching 12 is shown in FIG. 3 perpendicular to the reinforcement stitching 12 adjacent to rectangular-shaped fastener 46 that would be used for sealing an opening employed for turning scarf-like member 4 right-side-out after securing a rectangular-shaped fastener 46 within its end, suggesting that a different method of manufacture was used for third preferred embodiment 34 than would have been for the second preferred embodiment 24 shown in FIG. 2. In third preferred embodiment 34, although not shown in FIG. 3, blind stitching that would not be visible from the front side of the present invention, could be used to close any opening left open for fabric reversal, or in the alternative, a short length of stitching 12 could be placed anywhere along the top or bottom edges of scarf-like member 4, preferably on the bottom edge where it would be less likely to be noticed by a casual observer. FIG. 3 further shows decorative embellishments 50 attached in an aesthetically pleasing array to the front surface of scarf-like member 4. It is contemplated that embellishments 50 could comprise pearls, beads, gemstones, rhinestones, small chains, lace, decorative trim, small buttons, patches, sequins, small tassels, reflective decorations, appliqués, and the like.

Although not shown in FIG. 3, and not limited thereto, it is contemplated for third preferred embodiment 34 to be made from fabrics and materials that are heavier than would be typically used for first preferred embodiment 2 and second preferred embodiment 24, such as but not limited to, cashmere, faux fur, wool, suede, leather, denim, velvet, quilted materials, and mink. Also, in third preferred embodiment 34 scarf-like member 4 would have a length dimension of approximately eleven inches, instead of the ten-and-one-half inch preferred length for second preferred embodiment 34. The corresponding height dimension of scarf-like member 4 would be approximately three-and-one-half inches. Since third preferred embodiment 40 is made from heavier and/or bulkier fabrics, it would preferably comprise a soft lining material (not shown). Any lining used could be detachably connected to scarf-like member 4 for laundering purposes. At a minimum a lining should be located centrally on the back surface of scarf-like member 4 where contact with the front of neck 24 is expected, however, lining material could also extend the full length and height dimensions of scarf-like member 4. If detachably connected to scarf-like member 4, a lining could comprise a plurality of snaps, hook-and-loop fasteners, or other means of connection that would not interfere with the comfort of a person having it in close contact with the neck. One contemplated fabric for use in lining scarf-like member 4, although not limited thereto, is silk. Also, to support the heavier and bulkier fabrics and materials used in third preferred embodiment 34, with one proposed example being shown in FIG. 12, it is contemplated that instead of using one segment of chain links or rings 6 on each end of scarf-like member 4, multiple segments of chain links or rings 6 could be attached to the ends of scarf-like member 4, as well as more than one rectangular-shaped connector 46 connected to each end of scarf-like material 4. Further, two or three small chain segments, such as small chains 104 in FIG. 12, could be employed on each side of scarf-like member 4 as part of the means used for enhanced support. When several small chains 104 are used on each side of scarf-like member 4, they could all interconnect with the proximal chain link or ring 6, or the outer small chains 104 could be longer and connect with other chain links or rings 6 adjacent to the proximal one. Also, in third preferred embodiment 34, the width dimension of chains links or rings 6, as well as the materials from which chain links or rings 6, rectangular-shaped connectors 46, and solid rectangular bands 36 are made, would be similar to that proposed for the second preferred embodiment 24 having subtle dip 30, so that less expensive embodiments could be offered for casual use, as well as more expensive embodiments for career and formal use.

FIG. 4 shows a fourth preferred embodiment 52 of the present invention having an elongated scarf-like member 4 with a V-shaped dip 58, a rectangular-shaped connector 46 attached to each end of scarf-like member 4, and an outwardly depending loop 48 centrally attached to each rectangular-shaped connector 46. FIG. 4 also shows the proximal end of a lobster claw fastener 56 connected to each outwardly depending loop 48. The use of rectangular connectors 46 with outwardly depending loops 48 is not critical and it is also considered within the scope of the present invention for chain-to-scarf connectors having other configurations to be used. Although two jewelry segments of unequal length are required for successful positioning scarf-like member 4 against a neck, such as neck 116 in FIG. 11, only jewelry component having several round chain links or rings 6 alternating with rectangular links 54 is shown in FIG. 4. By way of example and although not limited thereto, the composition of the shorter jewelry component which is not shown in FIG. 4 could include one chain link or ring 6 and one rectangular link 54, two chain links or rings 6 and one rectangular link 54, three chain links or rings 6, or simply one rectangular link 54, in addition to one or more adjustable fasteners, such as the toggle fastener 10 shown in FIG. 1. FIG. 4 shows the proximal chain link or ring 6 on the longer illustrated jewelry component in a position adjacent to one of the lobster claw fasteners 56 and poised for connection thereto. It is equally considered to within the scope of the present invention for lobster claw fastener 56 to be connected to the proximal chain link or ring 6 and poised for connection to the outwardly depending loop 48, or the distal rectangular link 54 on the opposing end of the longer jewelry component, instead of being connected to the outwardly depending loop 48, as is shown in FIG. 4. Although the height dimensions of the ends of scarf-like member 4, rectangular links 54, and chain links or rings 6 appear to be similar in size, scarf-like member 4 has been shortened to approximately half of its normal length relative to the length dimension of the illustrated jewelry component for illustrative purposes. Any adjustable fastener used in fourth preferred embodiment 52, such as but not limited to the toggle fastener 10 shown in FIG. 1, or any chain-to-scarf fastener used such as lobster claw fastener 56, should lie flat against the circumference of a neck, such as neck 116 in FIG. 11, and be configured bluntly so as not to snag clothing or lay uncomfortably against the skin of the person wearing it. In addition FIG. 4 shows two approximately parallel spaced-apart lines of reinforcement stitching 12 each adjacent to a different one of the rectangular-shaped connectors 46 to keep it in a substantially exposed and fixed position during use. FIG. 4 also shows V-shaped dip 58 centered on the lower edge of scarf-like member 4, with the lower edges of V-shaped dip 58 each independently formed into a very narrow rolled hem 20 instead of being stitched to one another with a hidden seam to keep the cut edges of the material used for scarf-like member 4 from the type of incidental contact during wear and/or laundering that would eventually cause it to have an undesirable frayed or tattered appearance. It is contemplated for V-shaped dip 58 to cover the lower front portion of a human neck and the upper central portion of the wearer's chest adjacent to the neck. Although not critical to the present invention, FIG. 4 shows the upper edge of scarf-like member 4 to have a substantially straight and unadorned configuration.

Although not shown in FIG. 4, and not limited thereto, it is contemplated for fourth preferred embodiment 52 of chain scarf invention having V-shaped dip 58 to be made from thin, soft, and lightweight fabrics, although some medium weight fabrics would also be suitable. When thicker fabrics and materials are used, and where necessary for the comfort of the person wearing it, a soft lining material (not shown) such as but not limited to silk could be attached to the back surface of scarf-like member 4. Such a lining could be permanently attached to scarf-like member 4, or detachably connected to it with easily engaged fasteners, such as snaps or hook-and-loop fasteners (not shown). Also, any lining used could be small in dimension and used only for the neck-engaging back surface in direct contact with the front of a neck, or a lining could be larger and extend the full length or height of scarf-like member 4, or both. Although not limited thereto, in fourth preferred embodiment 52, the length dimension of scarf-like member 4 would be approximately eleven inches. The corresponding maximum height dimension of scarf-like member 4 having a V-shaped dip 58 would approximately six inches. Although other sizes of chain links or rings 6 are considered within the scope of the present invention, in the corresponding jewelry component it is preferred that chain links or rings 6 and rectangular links 54 each have a height dimension of approximately three-fourths of an inch, the same height dimension as the ends of scarf-like member 4, and for the longer jewelry component shown in FIG. 4 to be approximately three inches in length. In fourth preferred embodiment 52, chain links or rings 6, rectangular links 54, and lobster claw fasteners 56 would be made from gold, silver, a combination gold and silver, gold-filled materials, gold plated materials, silver plated materials, and other non-tarnishing materials resembling gold and silver, to provide the versatility of being able to offer less expensive embodiments for casual use, as well as more expensive embodiments for career and formal use. Chain links or rings 6 and rectangular links 54 could also comprise decorative embellishments, such as but not limited to pearls, gemstones, semi-precious stones, and rhinestones. Decorative embellishments are also contemplated for the scarf-like member 4 in fourth preferred embodiment 50, and could include but should not be limited to fringe, lace, appliqués, pearls, beads, sequins, gemstones, semi-precious stones, small tassels, embroidery, rhinestones, small buttons, patches, reflective decorations, small chains, lace, other decorative trim, and the like.

FIG. 5 shows a fifth preferred embodiment 60 of the present invention with a scarf-like member 4 having a subtle dip 30. FIG. 5 also shows a trapezoidal connector 68 connected to each end of scarf-like member 4 and a box-like receiving member 66 of a two-part detachable chain-to-scarf connector connected to the distal end of trapezoid connector 68. FIG. 5 further shows several interconnected diamond-shaped links 62 attached on one of its ends to the second spring-biased member 64 of the two-part detachable chain-to-scarf connector. Although two jewelry segments are required for successful positioning scarf-like member 4 against a neck, such as neck 116 in FIGS. 11 and 13, only the longer jewelry component is shown in FIG. 5. By way of example and although not limited thereto, the composition of the shorter jewelry component which is not shown in FIG. 5 could include two or three diamond-shaped links 62, two or three chain links or rings 6, or a combination of alternating chain links or rings 6 and diamond-shaped links 62, in addition to one or more adjustable fasteners, such as the toggle fastener 10 shown in FIG. 1. Although FIG. 5 shows spring-biased member 64 attached to the proximal end of the illustrated jewelry component and box-like receiving member 66 attached to the distal end of trapezoidal connector 68, the reverse is also considered to be within the scope of fifth preferred embodiment 60 where spring-biased member 64 would be attached to trapezoidal connector 68 and box-like receiving member 66 is attached to the proximal end of the shorter jewelry segment. Although the height dimensions of the ends of scarf-like member 4 and diamond-shaped links 62, appear to be similar in size, scarf-like member 4 has been shortened to approximately half of its normal length relative to the length dimension of the illustrated jewelry component for illustrative purposes. Any adjustable fastener used in fifth preferred embodiment 60, such as but not limited to the toggle fastener 10 shown in FIG. 1, as well as any chain-to-scarf fastener used, should lie flat against the circumference of the neck and be configured bluntly so as not to snag clothing or lay uncomfortably against the skin of the person wearing it. In addition FIG. 5 shows two approximately parallel spaced-apart lines of reinforcement stitching 12 each adjacent to a different one of the trapezoid connectors 68 to keep it in a substantially exposed and fixed in position during use. FIG. 4 also shows subtle dip 30 centered on the lower edge of scarf-like member 4 and additional stitching 12 used as a top-stitching type of decoration near to the lower perimeter edge of subtle dip 30. Although not critical to the present invention, FIG. 5 shows the upper edge of scarf-like member 4 to have a substantially straight and unadorned configuration, and the upper edge of scarf-like member 4 can be curved, angular, or curvilinear.

FIG. 6 shows a sixth reversible preferred embodiment 70 of the present invention having a substantially unfolded scarf-like member, represented by the numbers 4*a* and 4*b*. First scarf-like member 4*a* and second scarf-like member 4*b* are similar in size and configuration, so that one can be worn hidden from view when connected to the other and their ends are drawn behind a human neck, such as neck 116 in FIG. 11 by a two-part jewelry component, such as the chain links or rings 6 and toggle 10 in FIG. 1. It is contemplated for first scarf-like member 4*a* and second scarf-like member 4*b* to be different in color, pattern, and/or texture, so that sixth preferred embodiment 70 can be worn with a wider variety of fashions than if only one type of material was used for both scarf-like members 4*a* and 4*b*. FIG. 6 shows the top edges 74 of scarf-like members 4*a* and 4*b* connected to one another with the seam edges hidden from view. Scarf-like members 4*a* and 4*b* would also be folded one behind the other at top edges 74, either right-side out or inside out depending upon the connection of any remaining perimeter edges 76. After scarf-like members 4*a* and 4*b* are aligned with one another, remaining perimeter edges 76 can be joined together and connectors, such as trapezoidal connectors 68 in FIG. 5, can be secured within the ends of the combined scarf-like members 4*a* and 4*b*. FIG. 6 also shows the seam line 72 that would be used for stitching scarf-like members 4*a* and 4*b* to one another. Stitching could occur with the right sides of scarf-like members 4*a* and 4*b* facing one another, after which scarf-like members 4*a* and 4*b* would be turned right-side out, with the opening used for such turning being top stitched or blind stitched for closure. In the alternative, scarf-like members 4*a* and 4*b* could be stitched with its right sides facing away from one another and their cut edges folded under at seam lines 72 so that the cut edges are positioned and remain between scarf-like members 4*a* and 4*b* during and after stitching, after which, since the right sides of scarf-like members 4*a* and 4*b* would already be facing away from one another there would be no need to turn scarf-like members 4*a* and 4*b* right-side-out, and no opening would need to be sealed with top stitching or blind stitching. Also, in the most preferred embodiment, although not limited thereto, the seam line 72 is positioned a minimum distance of approximately one-fourth of an inch from perimeter edge 76 and a maximum distance of approximately five-eighths of an inch from perimeter edge 76. Although not shown, depending upon the type of fabric used for scarf-like members 4*a* and 4*b*, the stitching used for seam line 76 can comprise straight stitching, zig-zag stitching, or both, with zig-zag stitching being used on more delicate and loosely woven fabrics to prevent puckering, or as a means of binding cut edges that could be easily fray during use.

FIG. 7 shows the two-part scarf-to-chain fastener used in the fifth preferred embodiment 60 of the present invention shown in FIG. 5 and having a box-like receiving member 66 with a spring-biased member 64 that has a tapering distal end for engagement with box-like receiving member 66. FIG. 7 shows box-like receiving member 66 having a housing 82 with a hollow interior and a slot 84 communicating with the hollow interior, while FIG. 7 further shows spring-biased member 64 having an L-shaped base member 80 and an upper portion 78 that is pivotally connected at its proximal end to one end of L-shaped base member 80. When secure connection between spring-biased member 64 and box-like receiving member 66 is desired, a downward force can be applied to upper portion 78 to make it pivot from its proximal end downward toward L-shaped base member 80, and into a more flattened configuration. While in such a flattened configuration, the tapering proximal end of spring-biased member 64 can be inserted into slot 84. Subsequent release of upper portion 78, which causes spring-biased member 64 to attempt to return to its original expanded configuration, thus locks spring-biased member 64 within housing 82 until the upper portion 78 is again depressed toward L-shaped base member 80 and temporarily returned to the flattened configuration that would allow it to be easily withdrawn from slot 84. Although not limited thereto, it is contemplated in fifth embodiment 60 for spring-biased member 64 and box-like receiving member 66 to be made from the same materials used for trapezoidal connector 68 and diamond-shaped links 62. Further, the illustrations in FIGS. 5 and 7 for spring-biased member 64 and box-like receiving member 66 are representative only, and the actual length, width, and height dimensions, as well as the relative proportions used for spring-biased member 64 and box-like receiving member 66 may be varied from that shown.

Figure 8:
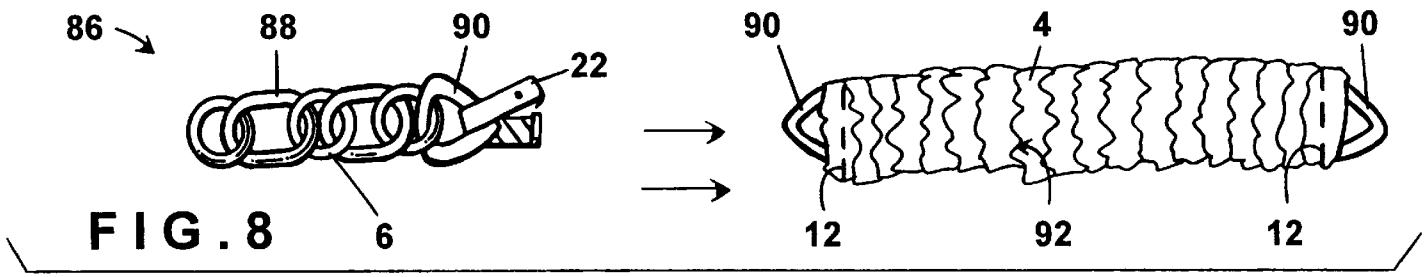
FIG. 8 is a plan view of a seventh preferred embodiment of the present invention having a substantially rectangular scarf-like member that has been shortened in length to create small puckers or wrinkles suggestive of a blouson effect, one chain segment having alternating round and elongated links near in size to the height dimension of the ends of the scarf-like member, a triangular-shaped connector attached to each end of the scarf-like member and the proximal end of the chain segment, with the triangular-shaped connector on the proximal end of the chain segment being in a position poised for attachment to one of the triangular-shaped connectors attached to the scarf-like member through use of the V-shaped fastener shown in FIGS. 1 and 2.
Figure 9:
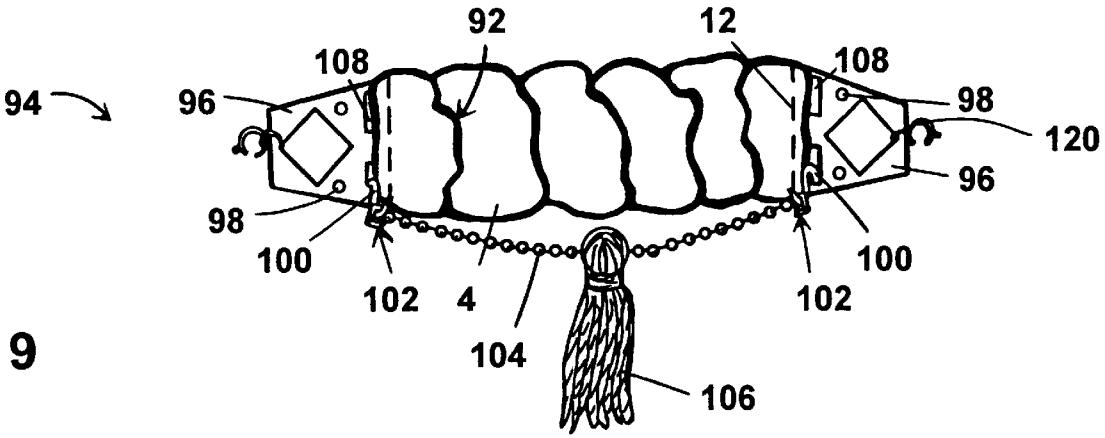
FIG. 9 is a plan view of an eighth preferred embodiment of the present invention having a substantially rectangular scarf-like member that has been shortened in length to create large puckers or wrinkles suggestive of a blouson effect, a trapezoid-shaped connector attached to each end of the scarf-like member, and a tassel attached to a small chain that is connected on its opposing ends to the two trapezoid-shaped connectors through the use of S-shaped hooks and small rectangular-shaped closed loop connectors.

FIGS. 8 and 9 respectively show seventh preferred embodiment 86 and eighth preferred embodiment 94, both having scarf-like members 4 that are substantially rectangular in configuration but somewhat shortened in length so as to be puckered or gathered into folds or wrinkles 92 and create a blouson effect. The scarf-like member 4 in FIG. 8 has more closely gathered folds or wrinkles 92 than does the scarf-like member 4 shown in FIG. 9. FIG. 8 also shows a triangular-shaped connector 90 being attached to each of the ends of scarf-like member 4, and well as to the proximal end of the illustrated jewelry component having alternating elongated links 88 and chain links or rings 6. Although only one jewelry-like segment is shown in FIG. 8, two jewelry-like segments of unequal length and esthetically complementary configuration would be required to draw the ends of scarf-like member 4 around to the back of a human neck, such as neck 116 in FIG. 11, and secure scarf-like member 4 comfortably against neck 116. FIG. 8 further shows reinforcement stitching 12 on scarf-like member 4 adjacent to each triangular connector 90, in addition to a V-shaped pivoting fastener 22 that is engaging the triangular connector 90 attached to the proximal end of the illustrated jewelry component, and also poised for connection to a second triangular connector 90 attached to the adjacent end of scarf-like member 4. The eighth preferred embodiment 94 shown in FIG. 9 has enlarged trapezoidal chain-to-scarf connectors 96, with a ring fastener 120 having a sliding type of clasp action secured to the end of each trapezoidal connector 96 for attachment of scarf-like member 4 to a pair of jewelry-like segments, such as but not limited to the unequal lengths of the jewelry-like chains formed by chain links or rings 6 in FIG. 1. A small chain 104 is connected on each of its ends between the two opposing trapezoidal connectors 96 through use of a small rectangular closed loop 102 and an S-shaped hook 100. A large tassel 106 is also attached centrally to small chain 104. Tassel 106 can be made from any type of aesthetically pleasing material, including single color or multiple color metallic threads. Although not shown, an additional small chain 104 or string of pearls or beads (not shown) could be connected between trapezoidal connectors 96 in the positions currently occupied by S-hooks 100, with the S-hooks 100 currently attached to the ends of the illustrated small chain 104 being connected into the opposing upper rectangular openings 108, or either of the similarly located small round openings 98 located adjacent to but laterally from the rectangular openings 108 in trapezoidal connectors 96. Further, other types of embellishments, such as but not limited to one or more medallions (not shown) could be used in place of tassel 106. Both FIGS. 8 and 9 also show reinforcement stitching 12 adjacent to the ends of scarf-like member 4. To achieve the puckered or gathered blouson effect shown in either FIG. 8 or FIG. 9, it is contemplated for hidden stitching similar to reinforcement stitching 12 to be used, or to have a layer of some sort of interfacing positioned between triangular connectors 90 or trapezoidal connectors 96 to maintain a uniform length for scarf-like member 4. However, other means obvious to a seamstress for maintaining a uniform length in scarf-like member 4 would also be considered to be within the scope of the present invention. Further, although lightweight materials would be preferred to promote a good blouson effect, it is not contemplated for the scarf-like member 4 of the seventh preferred embodiment 86 or the eighth preferred embodiment 94 to be limited thereto.

Figure 10:
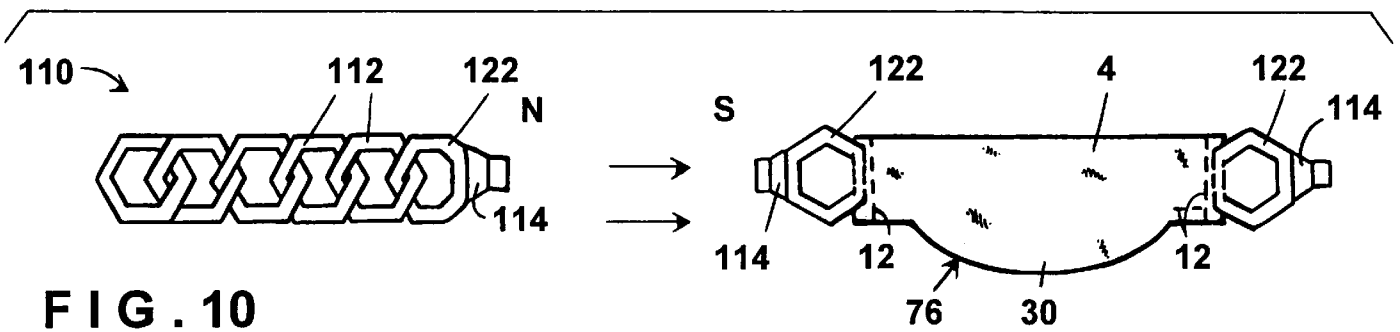
FIG. 10 is a plan view of a ninth preferred embodiment of the present invention having a scarf-like member with a subtle dip configured for following the curvature of a human neck, one chain segment having several hexagonal links near in size to the height dimension of the ends of the scarf-like member connected to an octagonal end link, an octagonal connector attached to each end of the scarf-like member, and the proximal end of the chain segment being in a position poised for attachment to one of the octagonal connectors attached to the scarf-like member through use of a two-part magnetic fastener.

FIG. 10 shows a ninth preferred embodiment 110 of the invention having a scarf-like member 4 with a subtle dip 30, a jewelry component with several hexagonal links 112 connected to one octagonal end link 122, additional octagonal links 122 being used in the opposing ends of scarf-like member 4 as connectors, and a two-part magnetic fastener being used as the chain-to-scarf detachable fastener. Although FIG. 10 shows the North portion of the two-part magnetic fastener 114 being connected to the distal octagonal link 122 and the South portion of the two-part magnetic fastener 114 being connected to the octagonal link 122 attached to one end of scarf-like member 4, the reverse is also considered to be within the scope of the present invention. FIG. 10 also shows reinforcement stitching 12 on scarf-like member 4 adjacent to each end thereof, as well as near to the bottom edge of one end of scarf-like member 4 between subtle dip 30 and the octagonal links 122 used as connectors. The bottom reinforcement stitching would be used to seal an opening left for turning scarf-like member 4 right-side-out after connecting the front and back perimeter edges of scarf-like member 4 and attachment of the hexagonal links 122 used as connectors, should a method needing such a fabric reversal step be employed.

Figure 11:
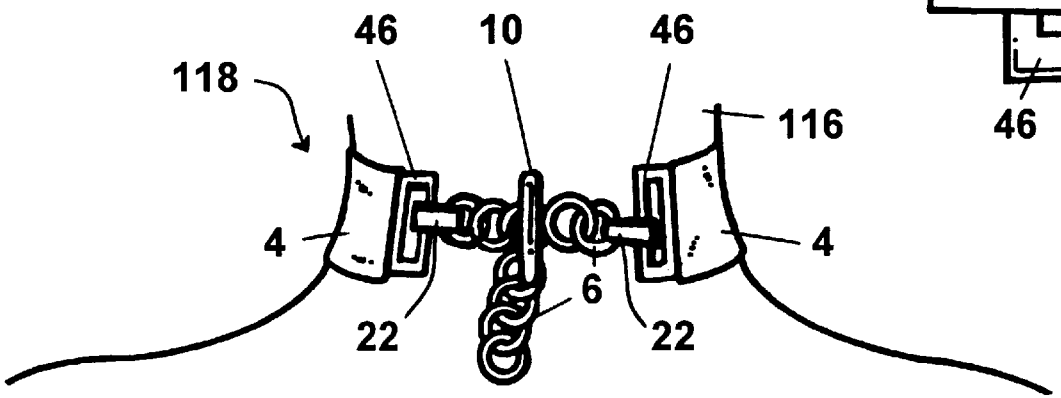
FIG. 11 is a back view of a tenth preferred embodiment of the present invention secured around a human neck and having a rectangular-shaped connector attached to each end of the scarf-like member, a snap-together fastener securing each rectangular-shaped connector to the jewelry portion, and the jewelry portion having round links and a toggle fastener.

FIG. 11 shows a tenth preferred embodiment 118 of the present invention encircling a human neck 116. Tenth preferred embodiment 118 has a rectangular connector 46 attached to each end of scarf-like member 4, with the fabric of scarf-like member 4 extending across the front and sides of neck 116, but leaving a preferred gap of approximately two to three inches across the back of neck 116. FIG. 11 further shows tenth preferred embodiment 118 having a jewelry component comprising chain links or rings 6 that is connected to scarf-like member 4 through use of two detachable fasteners 22, similar to the connection of scarf-like member 4 to its associated jewelry components in FIG. 1. Adjustable connection of the jewelry component is made with a toggle fastener 10, attached to the short segment of interconnected chain links or rings 6, being inserted into different ones of chain links or rings 6 on the longer segment, with the chain or link 6 selected for toggle 10 connection being determined according to the size of neck 116. During use, several chain links or rings 6 from the longer chain segment typically hang downwardly below toggle fastener 10, and in most instances of use toggle fastener 10 becomes approximately centered between rectangular connectors 46. It is not critical whether detachable fasteners 22 are permanently affixed to rectangular connectors 46, permanently affixed to the proximal chain link or ring 6, or remain completely detachable between uses from both rectangular connectors 46 and chain links or rings 6. The amount of the rectangular connectors 46 visible in FIG. 11 is a design consideration and can be varied during manufacture to suit changing needs. This same design consideration also applies to the visible portion of other connectors contemplated for use with scarf-like members 4, such as D-rings 8 in FIG. 1, decorative D-shaped connectors in FIG. 2, trapezoidal connectors in FIG. 5, triangular connectors 90 in FIG. 8, and octagonal connectors 122 in FIG. 10.

Figure 12:
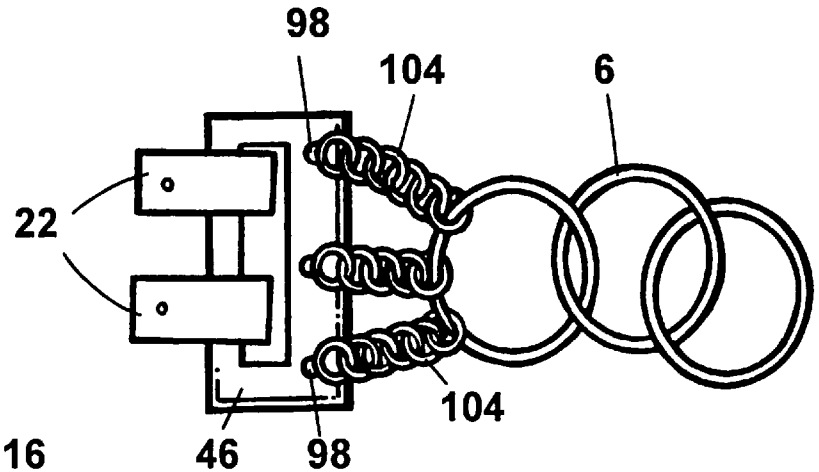
FIG. 12 is an enlarged view of the jewelry portion of an eleventh preferred embodiment of the present invention having a rectangular-shaped link connected to round links through use of three small chain segments, with the rectangular-shaped link being contemplated for connection by a detachable fastener to a scarf-like member.

FIG. 12 shows an alternative means of attaching chain links or rings 6 to wider scarf-like members 4, through use of two detachable fasteners 22 connected to a rectangular connector 46. A second rectangular connector 46 could be attached to the scarf-like member 4 intended for connection to the two detachable fasteners 22 shown in FIG. 12 so that the two detachable fasteners 22 become symmetrically secured between two rectangular connectors 46, similar to the symmetrical use of detachable fastener 22 in FIG. 8 between two adjacent triangular connectors 90. As shown in FIG. 12, should the height dimension of rectangular connector 46 be significantly larger than that of chains or rings 6, whether for the purpose of accommodating scarf-like members 4 with a taller height dimension or for design considerations, the attachment of rectangular connector 46 to the proximal chain or ring 6 could be stabilized by use of several small chains 104. As further shown in FIG. 12, one small round opening 98 through the side of rectangular connector 46 remote from that used for connection of detachable fasteners 22, could be used for the connection of one end of each small chain 104.

FIG. 13 shows second preferred embodiment 24 having a scarf-like member 4 with a subtle dip 30 being secured against the lower portion of a human neck 116. Since scarf-like member 4 covers the front and sides of neck 116, as can be seen in FIG. 13, the jewelry component remains hidden from view. This would also be true for most embodiments of the present invention unless the person wearing it had an unusually large neck circumference. Depending upon the preference of a user, scarf-like member 4 can be worn comfortably against the middle or lower portion of neck 116, but rarely would be worn upon the upper part of neck 116. Although not shown in FIG. 13, the opposing ends of one or more small chains 104, or a string of pearls or beads (not shown), could be connected to the hidden jewelry component attached to the ends of scarf-like member 4 and allowed to hang below subtle dip 30. Embellishments, such as the rhinestone embellishments 14 shown in FIG. 1, the beads or pearls 50 shown in FIG. 3, or other decorative objects such as but not limited to one or more medallions (not shown) could also be secured to scarf-like member 4 or any of the small chains 104 contemplated for use.

To wear the present invention as a fashion accessory, one would select an embodiment having scarf-like member 4 made from fabric or material appropriate to the style of clothing with which it is to be worn, either formal wear, casual wear, or career oriented fashions. Then one would select an embodiment having scarf-like member 4 with a configuration appropriate to the style of clothing chosen for use, either first preferred embodiment 2 having a cowl-like dip 18, second preferred embodiment 24 having a subtle dip 30, third preferred embodiment 34 having no dip, or fourth preferred embodiment 52 having a V-shaped dip 58. The next selection would be to provide a scarf-like member 4 with colors that either complement or create a color accent for the casual garments or fashion ensemble chosen for use. To further customize the present invention for use, detachable decorative embellishments can be added to scarf-like member 4, including multiple rows of small chains 104, or strings of beads or pearls 50, shown individually in FIG. 3 by the number 50, that would hang below scarf-like member 4, as well as tassels 106. Although not illustrated, if a soft detachable lining is needed for the comfort of the person wearing the present invention, a lining made from fabric such as silk could be added to the entire back surface of scarf-like member 4, or only a portion of it, with snaps or hook-and-loop fasteners. Then, once the selected scarf-like member 4 is amply embellished and ready for use, the wearer would select the type of multiple segment jewelry components, such as chain links or rings 6, and the detachable chain-to-scarf fasteners most suitable for use from a convenient or design perspective, such as but not limited to snap-together detachable fasteners 22, and connect the selected jewelry components via the detachable chain-to-scarf fasteners to the selected scarf-like member 4. The wearer, or someone assisting the wearer, would then grasp each of the opposing chain segments with a different hand and draw chain segments around to the back of the wearer's neck 116 while centering scarf-like member 4 against the front of neck 116, and fasten the opposing chain segments to one another so as to securely fix scarf-like means 4 against the neck. The position of scarf-like member 4 would typically be worn low on neck 116, or higher toward the middle part of neck 116. The distal ends of each chain segment would be drawn around to the back of neck 116, with the ends of scarf-like member 4 ideally remaining at a spaced-apart distance from one another that is approximately two to three inches. Thereafter, the adjustable fastener positioned at the distal end of the shorter chain segment, such as a toggle fastener 10 or a lobster claw fastener 42, would be used to engage an appropriate link on the longer chain segment to comfortably secure scarf-like member 4 into its usable position against the front of neck 116 without the wearer experiencing unpleasant neck constriction, or choking and gagging sensations. To remove the present invention from neck 116, one would simply disengage the fastener positioned at the end of the shorter chain segment from the connecting link on the longer chain segment and gravity would cause the present invention to fall away from neck 116. It is intended that the materials selected for scarf-like member 4 and the jewelry portion would keep maintenance of the present invention to a minimum between uses. The jewelry component, as well as the detachable chain-to-scarf and adjustable fasteners, such as toggle fastener 10, detachable fasteners 22, and lobster claw fastener 56, would be made from tarnish-free materials. Also, the scarf-like members 4 used for casual embodiments would be made from fabrics and materials that can be easily cleaned, or in the alternative have a detachable lining (not shown) that can be cleaned between uses.

To manufacture the first embodiment of the present invention, one would first provide a scarf-like member 4. For one-piece construction, the piece of fabric or other material provided for scarf-like member 4 would be approximately double in height, and slightly larger than the intended length and height dimensions of the assembled scarf-like member 4 to provide appropriate seam allowance. Once folded in half along a central longitudinal fold line 74, the fabric or other material used to make scarf-like member 4 would begin to resemble the ready-to-use configuration. One preferred method for attaching the fabric or other material used for scarf-like member 4 to the two-part jewelry component, would involve the placement of the right sides of the fabric or other material against one another with a jewelry component connector such as D-ring connector 8 therebetween, with a selected amount of D-ring connector 8 extending beyond each of the ends of scarf-like member 4, as shown in FIG. 1. After thread (not shown) is inserted through the fabric of scarf-like member 4 along seam line 72 to seal and secure the folded halves of scarf-like member 4 to one another at its opposing ends, scarf-like member 4 is turned right-side-out. If seam lines 72 extend along the entire perimeter edge 76 of scarf-like member 4, such as would be expected when rectangular scarf-like members 4 were used, or scarf-like members 4 with subtle dips 30, a small opening (not shown) would be left for turning scarf-like member 4 right-side-out, after which the small opening would be sealed with a short segment of reinforcement stitching 12 preferably on the lateral bottom edge of scarf-like member 4, such as shown in FIGS. 2 and 10. Also, once scarf-like member 4 is turned right-side-out, a line of reinforcement stitching 12 extending the full height of each opposing end of scarf-like member 4 is preferably added to scarf-like member 4 adjacent to D-ring connectors 8, to strengthen scarf-like member 4 during use and help maintain D-ring connector 8 in their preferred positions of use. If scarf-like member 4 is made from a one-piece construction and its lower edges are not stitched to one another, such as in the fourth preferred embodiment 52 having a V-shaped dip 58 or in the first preferred embodiment 2 having a cowl-like dip 18, the lower edges would be kept from unraveling by rolling and securing each of them individually and separately into a rolled hem 20. Decorative embellishments, such as but not limited to rhinestone embellishments 14 or pearl or bead embellishments 50, can be added to the exposed surface of scarf-like member 4, prior to folding and the attachment of the jewelry component connectors, such D-ring connectors 8, or in the alternative after the attachment of jewelry-to-scarf connectors, as needed for most efficient assembly. For two-piece or three-piece construction of scarf-like member 4, several options are possible. A single layer of material can be attached to an identically configured lining (not shown) of soft fabric such as silk, positioned with right sides together and opposing jewelry component connectors therebetween, stitched along seam lines 72 while leaving a small opening available for turning scarf-like member 4 right-side-out, followed by scarf-like member 4 being turned right-side-out so that lining completely covers the back surface of scarf-like member 4. In the alternative, a lining having the same perimeter dimension or a perimeter dimension smaller than that of a scarf-like member 4 can be added to the hidden surface of a two-layer scarf-like member 4 already secured to its complementary jewelry-to-scarf connector such as D-ring connector 8. Further, when scarf-like member 4 is made from two layers of sheer fabric or material, a third or even more layers can be placed between them for additional support and/or color contrast or accent, the third layer most likely being added during the step of connecting the jewelry component connector to scarf-like member 4. Reinforcement stitching 12 helps to reinforce the end of scarf-like member 4 and form a pocket within which the hidden portion of D-ring connector 8 is held during use. When reinforcement stitching 12 is placed closer to the end of scarf-like member 4, a larger the amount of D-ring connector 8 would remain continuously exposed beyond the end of scarf-like member 4 during use. During one preferred method of construction for chain scarf invention 2, seam line 72 extends along the entire perimeter of the material used for scarf-like member 4 and while the right sides of the material are in contact with one another, a majority of seam line 72 is stitched except one small portion that is used to turn scarf-like member 4 right-side-out and expose the visible portions of D-ring connectors 8, or other similar connectors attached to the opposing ends of scarf-like member 4, so that the connectors can be used to attach scarf-like member 4 to detachable fasteners, such as V-shaped detachable fastener 22. Once scarf-like member 4 has been turned right-side-out, the remaining unstitched part of seam line 72 will be closed with reinforcement stitching 12 in the form of topstitching or blind stitching (not shown), preferably with thread having a color closely matching that of the material used for scarf-like member 4. Although not limited thereto, the part of scarf-like member 4 left open for fabric reversal would preferably be positioned on the lower edge of scarf-like member 4, such as shown in FIG. 2, between one of its ends and subtle dip 14.

What is claimed is:

1. An adjustable clothing accessory for decorating a human neck that can be worn comfortably for extended periods of time while in a fixed position closely held against the neck, said fashion accessory comprising:

an elongated flexible scarf-like member with opposed ends, said scarf-like member being adapted for encircling the front and sides of a human neck without extending substantially across the back of the neck;

a plurality of connectors, at least one of said connectors being secured to each of said opposed ends, said connectors also having a jewelry-like appearance;

a first jewelry member having a distal end and a proximal end, said first jewelry member also having a plurality of chain links;

adjustable fastening means attached to said distal end of said first jewelry member;

a second jewelry member comprising a number of chain links greater than the number of said chain links in said first jewelry member, said chain links in said second jewelry member having a configuration adapted for easy engagement with said adjustable fastening means;

a plurality of detachable fasteners having a jewelry-like appearance, with at least one of said detachable fasteners being connected between said first jewelry member and the one of said connectors secured to a first one of said opposed ends of said scarf-like member, and at least one of said detachable fasteners being connected between said second jewelry member and the one of said connectors secured to the other one of said opposed ends of said scarf-like member; and said first and second jewelry members being adapted for extending across the back of a human neck and securely holding said scarf-like means against the front and sides of the neck so that said scarf-like means remains in an initially selected position on the neck during use.

2. The clothing accessory of claim 1 wherein said scarf-like member further comprises at least one soft neck-engaging surface adapted for contact with the front of a human neck.

3. The clothing accessory of claim 2 wherein said soft neck-engaging surface is selected from a group consisting of permanently attached linings and detachable linings.

4. The clothing accessory of claim 1 wherein said connectors are selected from a group consisting of D-ring connectors, decorative D-shaped connectors, rectangular connectors, rectangular connectors having at least one outwardly extending loop, trapezoidal connectors, triangular connectors, hexagonal connectors, and octagonal connectors.

5. The clothing accessory of claim 1 wherein said scarf-like member is substantially rectangular in configuration with a length that is shortened to make folds and wrinkles that create a blouson effect.

6. The clothing accessory of claim 1 wherein said scarf-like member comprises materials selected from a group consisting of silk, polyester, linen, rayon, chiffon, cashmere, faux fur, wool, suede, leather, denim, velvet, quilted materials, and mink.

7. The clothing accessory of claim 1 wherein said scarf-like member has maximum length and height dimensions of approximately eleven inches and six inches, respectively.

8. The clothing accessory of claim 1 further comprising at least one decorative embellishment connected to said scarf-like member.

9. The clothing accessory of claim 8 wherein at least one said embellishment is positioned so as to hang below said scarf-like member.

10. The clothing accessory of claim 1 wherein said detachable fasteners are selected from a group consisting of V-shaped pivoting fasteners that can be closed to form a loop, fasteners having a sliding clasp action, lobster claw fasteners, spring-biased fasteners, and magnetic fasteners.

11. The clothing accessory of claim 1 wherein said first and second jewelry members comprise materials selected from a group consisting of gold, silver, pearls, gemstones, rhinestones, gold-filled materials, gold-plated materials, silver-plated materials, and nontarnishing materials resembling gold and silver.

12. The clothing accessory of claim 1 wherein said scarf-like member comprises a lower dip.

13. The clothing accessory of claim 12 wherein said lower dip is selected from a group consisting of convexly-shaped subtle dips having a configuration adapted for subtly following the curvature of a human neck, cowl-like dips, and V-shaped dips.

14. A clothing accessory for decorating a human neck that can be worn comfortably for extended periods of time while in a fixed position closely held against the neck, said clothing accessory comprising:

scarf-like means with opposed ends and being adapted for encircling the front and sides of a human neck without extending substantially across the back of the neck;

connection means secured to each of said opposed ends of said scarf-like member, said connection means being jewelry-like in appearance;

elongated two-part jewelry means with each said part having a distal end and a proximal end, one of said parts having a greater length dimension than the other, and said distal ends being configured for engagement with one another so as to provide variability in the amount of said jewelry means available for extending across the back of a neck; and fastening means being jewelry-like in appearance and adapted for detachable connection between each of said proximal ends of said two-part jewelry means and a different one of said connection means attached to said opposed ends of said scarf-like member so that when said distal ends of said two jewelry means parts are adjusted so as to hold said scarf-like member securely against a human neck, said scarf-like means remains in an initially selected position on the neck during use.

15. A method for manufacturing a chain-scarf clothing accessory that is used for decorating a human neck and which can be worn comfortably while in a position closely against the neck that allows said accessory to remain in an initially selected position throughout use, said method comprising the steps of:

providing a plurality of elongated scarf-like members each with opposed ends, a length dimension sufficient to partially encircle a human neck, an exposed surface, a neck engaging surface, and a perimeter dimension slightly greater than twice that desired when said scarf-like member is ready for use, at least one fabric member having a length dimension sufficient to partially encircle a human neck and a perimeter dimension slightly greater than that desired when said scarf-like member is ready for use;

also providing a plurality of elongated chain segments having different length dimensions, a plurality of jewelry connectors; a plurality of adjustable jewelry fasteners adapted to lay flat during use, a plurality of detachable jewelry fasteners adapted to lay flat during use, a plurality of linings made from soft fabric, and a plurality of decorative embellishments;

selecting one of said scarf-like members having a perimeter dimension slightly greater than twice that desired when said scarf-like member is ready for use;

folding said selected scarf-like member approximately in half so that said exposed surface and said neck engaging surface face one another;

selecting at least two of said jewelry connectors;

attaching at least one of said jewelry connectors to each of said opposed ends of said first scarf-like member;

optionally selecting a second one of said scarf-like members;

optionally adding at least one of said decorative embellishments to said exposed surface of said scarf-like member;

optionally adding at least one of said linings to said neck engaging surface of said scarf member;

selecting at least two of said chain segments having different length dimensions;

selecting at least one of said adjustable jewelry fasteners;

connecting each said adjustable jewelry fastener to the shorter ones of said chain segments;

selecting at least two of said detachable jewelry fasteners; and separably connecting at least one of said detachable jewelry fasteners between each of jewelry connectors and at least one of said chain segments.

16. The method of claim 15 wherein said scarf-like members comprise materials selected from a group consisting of silk, polyester, linen, rayon, chiffon, cashmere, faux fur, wool, suede, leather, denim, velvet, quilted materials, and mink.

17. The method of claim 15 wherein said jewelry connectors are selected from a group consisting of D-ring connectors, decorative D-shaped connectors, rectangular connectors, rectangular connectors having at least one outwardly extending loop, trapezoidal connectors, triangular connectors, hexagonal connectors, and octagonal connectors.

18. The method of claim 15 wherein said jewelry members comprise materials selected from a group consisting of gold, silver, pearls, gemstones, rhinestones, gold-filled materials, gold-plated materials, silver-plated materials, and non-tarnishing materials resembling gold and silver.

19. The method of claim 15 wherein said scarf-like members each have a configuration selected from a group consisting of convexly-shaped subtle dips having a configuration adapted for subtly following the curvature of a human neck, cowl-like dips, and V-shaped dips.

20. The method of claim 15 wherein said detachable jewelry fasteners are selected from a group consisting of V-shaped pivoting fasteners that can be closed to form a loop, fasteners having a sliding clasp action, lobster claw fasteners, spring-biased fasteners, and magnetic fasteners.

* * * * *